US005765988A

United States Patent [19]

Guner et al.

[11] Patent Number: 5,765,988

[45] Date of Patent: Jun. 16, 1998

[54] CONTINUOUS APPAREL-SEWING MANUFACTURING SYSTEM

[75] Inventors: Mahmut Guner, Landenberg, Pa.; David A. Rosenblitt, Mountainview, Calif.

[73] Assignee: Gestalt Technologies, Inc., Mountain View, Calif.

[21] Appl. No.: 609,389

[22] Filed: Mar. 1, 1996

[51] Int. Cl.[6] ..... B23P 21/00

[52] U.S. Cl. ..... 414/787; 29/469; 29/711

[58] Field of Search ..... 414/266, 268, 414/269, 270, 273, 786, 787; 186/44, 45; 29/411, 429, 469, 711

[56] References Cited

U.S. PATENT DOCUMENTS 4,035,904 7/1977 Ishizaka et al. ..... 414/273 X 4,651,863 3/1987 Reuter et al. ..... 414/787 X 4,722,653 2/1988 Williams et al. ..... 29/711 X 4,821,197 4/1989 Kenik et al. ..... 414/273 X 5,239,739 8/1993 Akeel et al. ..... 29/469 X 5,363,310 11/1994 Haj-Ali-Ahmada et al. ..... 414/273 X 5,584,118 12/1996 Furukawa et al. ..... 29/711 X

*Primary Examiner*—James W. Keenan

*Attorney, Agent, or Firm*—Crowell & Moring LLP

[57] ABSTRACT

A system for continuous manufacture of apparel using continuous first-in-first-out work-in-process queues. The system is comprised of a dual queue where manufacture article components and article subassemblies can be performed simultaneously at a series of work centers all located around a center staging area.

24 Claims, 16 Drawing Sheets

CONTINUOUS APPAREL-SEWING MANUFACTURING SYSTEM

BACKGROUND

1. Field of the Invention

The present invention relates to the design and operation of continuous systems for concurrent apparel-sewing manufacturing of multiple product lines.

2. The Prior Art

Conventional apparel-sewing manufacturing systems are discrete. We differentiate discrete manufacturing and continuous manufacturing regarding their treatment of work-in-process queues. A work-in-process queue determines the order in which a collection of work-in-process items is to be processed. Discrete manufacturing requires explicitly scheduling of work-in-process queues. That is, a scheduler must explicitly judge the relative priorities of the items in the queue (e.g., to perform load balancing), and as a result of this judgment, may decide to reshuffle the order of the items in the queue. In contrast, continuous manufacturing work-in-process queues are self-scheduling, via an intrinsic load balancing mechanism, and do not require any explicit (external) scheduling. Continuous work-in-process queues are first-in-first-out (FIFO) queues. That is, the first item to enter the queue will be processed first, the second item to enter the queue will be processed second, etc., and the last item to enter the queue will be processed last. Therefore, the order in which work-in-process items are to be processed is fully determined by the order in which they entered the queue. Priorities are fully determined by queue order, an external judge of relative priorities is not required. Thus, the flow of items from the work-in-process queue to work centers (processing areas) is continuous, and is not interrupted by the discrete queue reshuffling activities of an external scheduler.

Conventional discrete apparel-sewing manufacturing systems are based on complex operations that are specific to the output, or type of component produced. Since operations in conventional apparel-sewing manufacturing systems are specific to particular components, we say that conventional apparel-sewing manufacturing operations are "component-oriented". In addition, these complex operations often contain common (therefore redundant) sub-operations, which makes it very difficult to change operations in a coherent fashion. For example, using a conventional manufacturing system for making shirts, there would be separate work centers for manufacturing the various shirt components: the shirt front, the shirt back, sleeves, pockets, etc. Unfortunately, such operations contain many redundant sub-operations that are performed at multiple work centers. For example, top-stitching, seaming, and cutting operations must be done at all of these work centers. (Seams are threads that are not visible in the final product, whereas top-stitches are visible in the final product.) When a top-stitching, seaming, or cutting process is modified at one work center, it should also be modified at the other work centers, in order to ensure consistent quality. This must be accomplished by an additional quality control techniques (e.g., statistical process control) and a management layer, which adds to the bureaucracy. In addition, for high-quality shirts, since top-stitched threads must be the same color within a particular shirt, these threads must be drawn from the same dye lot, since each lot has a unique color (i.e., each blue dye lot is a different shade of blue). Therefore, an unnecessary, and highly complex, resource sharing and scheduling problem has been introduced. This difficult scheduling problem creates large work-in-process queues at most activity centers, resulting in high cycle time (cycle time is the time an item spends in the factory, from the customer's initial order to the final product delivery).

Conventional component-oriented manufacturing systems are slow to respond to changes in the marketplace, due to their high work-in-process and cycle time. For similar reasons, conventional manufacturing systems are slow to respond to changes in the manufacturing capacity. Lower responsiveness to market fluctuations and manufacturing capacity fluctuations translates into higher inventory write-offs (wasted inventory), as well as more frequent inventory shortages, since the products that are actually manufactured may not be the products currently demanded by the marketplace.

Conventional component-oriented manufacturing systems have low adaptability, since every time a component is modified or added, a work center must be added or modified. This discourages factories from producing multiple product lines, which again restricts the capability of the manufacturing system to adapt to the changing needs of the marketplace (e.g., quickly switching to a more popular product line). In fact, in the apparel industry, the biggest barrier to mass-producing a new style is the high "setup" cost of modifying work stations to develop new components.

Conventional component-oriented manufacturing systems have low flexibility, since the expertise of personnel and machines becomes over-specialized and compartmentalized to a specific component, and cannot be applied to other components (e.g., a pocket-maker is unable to make a sleeve).

Exceptions are events that cannot be handled by a workflow. When exceptions arise, operations are in flux, and require timely adaptation in order to respond to the exceptional event or crisis. However, conventional component-oriented manufacturing systems have low responsiveness, since they are rigid (low flexibility), and therefore have difficulty responding quickly and effectively to changes or unanticipated events (i.e., exceptions to the normal, expected workflow). One typical response is to form new departments to handle exceptions, which guarantees that exceptions will continue to exist, and that the bureaucracy will continue to grow (the exceptions become the rationale for the existence of these new departments!).

To summarize, conventional component-oriented manufacturing systems create intrinsic redundancy, and therefore quality degradation (requiring bureaucratic managerial layers to ensure consistent quality), and complex resource scheduling problems (which increase work-in-process, cycle time, and inventory write-offs). Furthermore, conventional manufacturing systems are rigid, unresponsive, and virtually impossible to integrate, as attempts at integration tend to exacerbate the scheduling problems and bloat the bureaucracy.

GLOSSARY

The following brief description of terms used will aid in understanding the present invention:

Assembly Operations assemble finished components into a finished product.

Bundling refers to the packaging of raw materials, work-in-process, or finished products. Bundling is unnecessary with the present invention, since the same cart will contain the initial raw materials, intermediate work-in-process, and finished products (all corresponding to the initial batch of raw materials).

Carts carry subassemblies-in-progress between work centers, beginning with finished components, and ending with a finished product, such as a shirt. Carts are specially designed to store work-in-process in a variety of forms (e.g., folded, hung, or simply lying unfolded). Carts also bring raw materials into the manufacturing system.

Central Staging Area is where transportation carts park, waiting for their components to be manufactured.

Component Manufacturing Operations convert raw materials into finished components.

Consolidation means joining two or more batches of items so that they may be processed together.

Continuous manufacturing does not require explicit (external) scheduling of work-in-process queues. These queues are self-scheduling, via intrinsic load balancing mechanisms.

Discrete manufacturing requires explicitly scheduling of work-in-process queues.

Feedback Loop—once a self-regulating process reaches a threshold condition, the process reverses itself, similar to the way a thermostat automatically turns off a heating system once the desired temperature is reached.

First-in-first-out (FIFO) circular queue, means the first item to enter the queue will be processed first, the second item to enter the queue will be processed second, etc., and the last item to enter the queue will be processed last.

Head of queue is the first item in the queue.

Parking spaces in the central staging area indicate (uniquely) where each cart should be parked. Parking spaces are organized into groups of 4, separated by aisles, which are traversed by carts (and tub carriers) heading to and from the parking area.

Process-oriented manufacturing systems are based on a small number of core, generic, non-redundant operations, which may be combined to manufacture a wide variety of products, where each product is manufactured via specific (possibly complex) sequences of these core operations.

Rigid (component-oriented) manufacturing systems are based on complex operations (with simple flows between operations) that are specific to the output, or type of component produced.

Setups are operations that must be performed in order to enable some other desired operation.

Subassembly is a collection of finished components and smaller subassemblies, that are treated as a unit.

Tubs carry components-in-progress between work centers, beginning with raw materials, and ending with a finished component, such as a shirt front.

Tub Carriers transport tubs between work centers, or between a work center and the central staging area.

Vehicle—either a cart or a tub carrier.

Work Centers are places where operations are performed. The work centers in the present invention correspond to the seven "pure process" operations.

SUMMARY OF THE INVENTION

The present invention is a continuous apparel-sewing manufacturing system, containing an intrinsic load balancing mechanism that automatically manages work-in-process queues, such that explicit scheduling of work-in-process is not required. The particular manufacturing system disclosed also allows an additional scheduling optimization: garment assembly operations may begin before all garment components are manufactured.

The present invention is based on a small number of core, generic, non-redundant operations. These operations may be combined to manufacture a wide variety of products, where each product is manufactured via specific (possibly complex) sequences of these core operations. The flows among these (relatively simple) operations may be complex, which necessitates cleverly designed transportation equipment to allow arbitrary sequences of operations to be executed, by allowing arbitrary movement of work-in-process (in a variety of forms) among work centers. Operations in the present invention are specific to a particular process; these operations are not specific to particular components, but rather are generic across multiple components. Therefore, we say that the present invention's manufacturing operations are "process-oriented", in contrast to conventional manufacturing operations, which are component-oriented. (Recall that conventional apparel-sewing manufacturing systems are based on complex operations that are specific to the type of component produced, where these operations often contain redundant sub-operations.)

More specifically, the present invention discloses a specific set of seven process-oriented operations (five skilled operations, and two unskilled operations) for an apparel-sewing manufacturing system. Each specific product will require a specific sequence of operations, and will define a specific path through the work centers corresponding to these operations. There is a work center for each of the five skilled operations, and a single work-center for the two un-skilled operations. Transportation tubs carry components-in-progress between work centers, beginning with raw materials, and ending with a finished component, such as a shirt front. Transportation carts carry subassemblies-in-progress between work centers, beginning with finished components, and ending with a finished product, such as a shirt. Transportation carts are specially designed to store work-in-process in a variety of forms (e.g., folded, hung, etc.).

The basic manufacturing system layout has a circular floor, with a central staging area, and six hexagon-shaped work centers placed around the perimeter. Each work center contains one or more machines for performing operations. There are two work-in-process queues associated with each machine: a tub queue and a cart queue. The tub queue contains components at various stages of manufacture; the cart queue contains subassemblies at various stages of assembly. These queues may be shared among multiple machines, if the number of workers is less than the number of machines. The basic manufacturing system layout may be expanded to include multiple sets of the six core work centers, where these different sets may share common work centers.

The manufacturing system operates as follows:

1) Initial Loading: Raw materials enter the manufacturing system in carts, which are parked in the center staging area. Each cart contains batches of raw materials to be manufactured into batches of components (e.g., one batch might contain the raw materials for shirt sleeves, or shirt fronts, etc.).

2) Component Manufacturing: Tubs (transported by tub carriers) visit a succession of work centers, as the raw materials batches are converted to batches of finished components. Batches of finished components are transported back to the central staging area via tub carriers and then placed back on the cart (which is still parked in the center staging area). It is also possible to consolidate some sets of finished components, before being placed back on the cart. Component-manufacturing operations may proceed concurrently (e.g., shirt fronts may be manufactured concurrently with shirt backs, sleeves, etc.).

3) Assembly: Once the cart is full (i.e., the cart contains all of the finished components corresponding to its original batch of raw materials), then the cart visits a series of work centers where successive assembly operations will be performed. When carts move between work centers, they must travel via the central staging area. Assembly operations must be performed sequentially, as the cart visits each successive work center.

4) Shipping: Once assembly is complete, the cart exits the manufacturing system, and waits at a shipping area. After unloading its finished products at the shipping area, the cart proceeds to a loading area, awaiting a new batch of raw materials.

The use of labeled parking spaces (organized into groups of 4 spaces, separated by aisles) in the central staging area allows assembly operations to begin before all components are manufactured. The idea is to instruct the cart to later return (once assembly has begun) to its designated parking space to pick up the "late" finished component. It is also possible to manufacture components in bulk, by storing some finished components at a cart parking space, to be later picked up by other carts requiring those finished components.

The tub queue is a first-in-first-out (FIFO) queue, implemented by a pair or chutes, that is simple and easy to use. Incoming tubs are loaded into the top chute, and outgoing tubs are released via the bottom chute.

The tub and cart work-in-process queues will be self-scheduling (without the need for external scheduling), via an intrinsic load balancing mechanism, providing the following constraints are satisfied:

1) At each work center, the tub queue dominates the cart queue. That is, the cart queue is processed only if the tub queue is empty.

2) The number of carts is fixed, for a given level of manufacturing system capacity.

Defects are handled by adding extra instructions to the instruction ticket for the batch containing the defect, where these extra instructions will either undo or discard the defect. Defects are undone at the work center for unskilled operations.

As pointed out in greater detail below, the process oriented manufacturing operation of this invention provides important advantages. For example, when manufacturing a shirt in a process oriented manufacturing operation, there would be separate work centers for each shirt-manufacturing process: top-stitching, seaming, cutting, etc. No redundancy would exist, since each operation (e.g., top-stitching) would be performed at a unique (although possibly geographically distributed) work center. When a top-stitching, seaming, or cutting operation is modified, it need only be modified at a single work center. Therefore, the previously mentioned quality control and resource scheduling problems characteristic of conventional apparel-sewing manufacturing systems do not arise with the present invention.

Quality also improves as a result of the self-correcting, nature of process-oriented manufacturing operations. Since process-oriented operations contain no redundancies, a unique work center (and therefore, a unique individual) is always responsible, and therefore accountable for the result. Quality deviations can be detected by the next work center in the flow (such that the next operation in a sequence cannot be performed if the previous operation was performed poorly or incorrectly), with reduced reliance on external quality control monitoring.

Process-oriented manufacturing offers high flexibility, since the expertise of personnel and machines is associated with generic processes, rather than specific components. As expertise is learned by factory personnel, productivity improves equally across a broad spectrum of specific products (we estimate a 20% overall productivity improvement over conventional rigid manufacturing systems). For example, a top-stitcher can work just as easily on a shirt pocket, sleeve, front, or back.

Process-oriented manufacturing offers high adaptability, and avoids setup costs when manufacturing a different end-product, or when manufacturing multiple end-products concurrently, since the core operations (and supporting equipment) do not require modification. The core operations may require some (quick) adjustments to their operating parameters (e.g., using a larger sewing head), but the core operation itself is essentially unchanged. For example, the same shirt-manufacturing processes (combined in a slightly different manner) would be sufficient to manufacture a new style of shirt. In addition, the basic shirt-manufacturing processes could be combined in different ways to produce an entirely different type of product, such as a coat (although this would require a few additional operations and equipment specific to coat-manufacturing, in addition to the shirt manufacturing operations and equipment). Work center utilization remains high even when manufacturing a wide variety of products, since the work centers are generic, and are involved in the manufacture of each product.

Process-oriented manufacturing offers high responsiveness, since operations have high flexibility, and therefore can quickly and effectively respond to changes or unanticipated events (e.g., schedule changes or additions). (Note that exception handling operations, by their very nature, are process-oriented, since exception handling requires timely, ideally real-time, and continuous response to unanticipated events.) This enables quicker and more effective response to changing market demand, for example, by allowing later production starts. For example, when the forecast changes, the manufacturing response can often be changed on paper (since production may not have yet begun), which reduces the production of obsolete or unpopular products, and frees up production capacity to produce the products that are actually in demand. Work-in-process may be kept in its most flexible state, such that it can be quickly manufactured into any one of a variety of end-products, depending on the fluctuating demand. Overall cycle time will be less than the theoretical minimum for conventional manufacturing systems, due to the elimination of long setup times when switching between product styles. Therefore, the present invention reduces work-in-process queues, cycle time, inventory write-offs, and inventory shortages.

To summarize, process-oriented manufacturing avoids the redundancy, and therefore the quality degradation and resource scheduling problems that are characteristic of conventional component-oriented manufacturing. The process-orientation also minimizes exceptions, and therefore the bureaucracy required to handle exceptions. Furthermore, process-oriented operations are flexible, adaptable, responsive, and easy to combine, and therefore integrate.

The concept of flexible transportation devices eliminates the need to ever perform any additional packaging or "bundling" of raw materials, work-in-process, or finished products, since the same transportation device will contain the initial raw materials, intermediate work-in-process, and finished products (all corresponding to the initial batch of raw materials).

As a final note, it would be relatively simple to automate a process-oriented factory (i.e., relative to the task of automating a conventional component-oriented manufacturing system), using dedicated machines which specialize in one of the generic operations (augmented with transportation machines to transfer work-in-process between work centers).

DETAILED DESCRIPTION OF THE PREFERRED EMBODIMENT

Operations

The following seven "pure process" operations are sufficient to cover all manufacturing related to apparel sewing manufacturing. Each specific product will require a specific sequence of operations, and will therefore define a specific path through these work centers.

Skilled Operations:

1) Uni-Surface Transformation (e.g., hemming, pleating, etc.)

2) Uni-Surface Reinforcement (e.g., edge top-stitching, sleeve set top-stitching, etc.)

3) Edge-Joining (e.g., seaming, etc.) of two or more surfaces

4) Overlay (e.g., placement of pockets on tops or jeans, etc.), where two or more surfaces are joined by controlling and aligning their bodies (the body is the entire surface, minus the edge). One of these bodies must be stationary.

5) Mutual Overlay (e.g., pant or shirt side closing, etc.), where two or more surfaces are joined by controlling and aligning their bodies (we do not require one body to remain stationary)

Un-Skilled Operations:

1) Inversion (e.g., reversing collars, cuffs, etc.)

2) Conditioning (e.g., pressing, trimming, etc.)

The core expertise required to perform these operations is material handling expertise to spatially orient fabric during sewing tasks. The skilled operations are listed in order of difficulty for manufacturing personnel. The simplest skilled operation is uni-surface transformation, followed by uni-surface reinforcement, edge-joining, overlay, and finally mutual overlay. A worker capable of performing a uni-surface reinforcement should be capable of performing a uni-surface transformation, and so forth. A worker capable of performing a mutual overlay should be capable of performing any of the skilled operations: uni-surface transformation, uni-surface reinforcement, edge-joining, and overlay.

Inversion and conditioning are essentially unskilled operations (capable of being performed by part-time, or "high-turnover" personnel). Inversion requires more skill than conditioning. Conditioning does not require any manual intervention while the operation is being performed. Inversion almost always follows one of the skilled operations, and therefore requires some knowledge of the goals of those operations.

The conditioning area is subdivided into two sections: one section performs sewing operations, and the other section performs non-sewing operations, such as undo operations that remove defects.

These queues may be shared among multiple machines (as shown in the topmost hexagon in FIG. 11), for example, if the number of workers is less than the number of machines. For example, if there is only one worker in a given work center, there might be only one active cart queue, and only one active tub queue, regardless of the number of machines.

Transportation Devices

Figure 1:
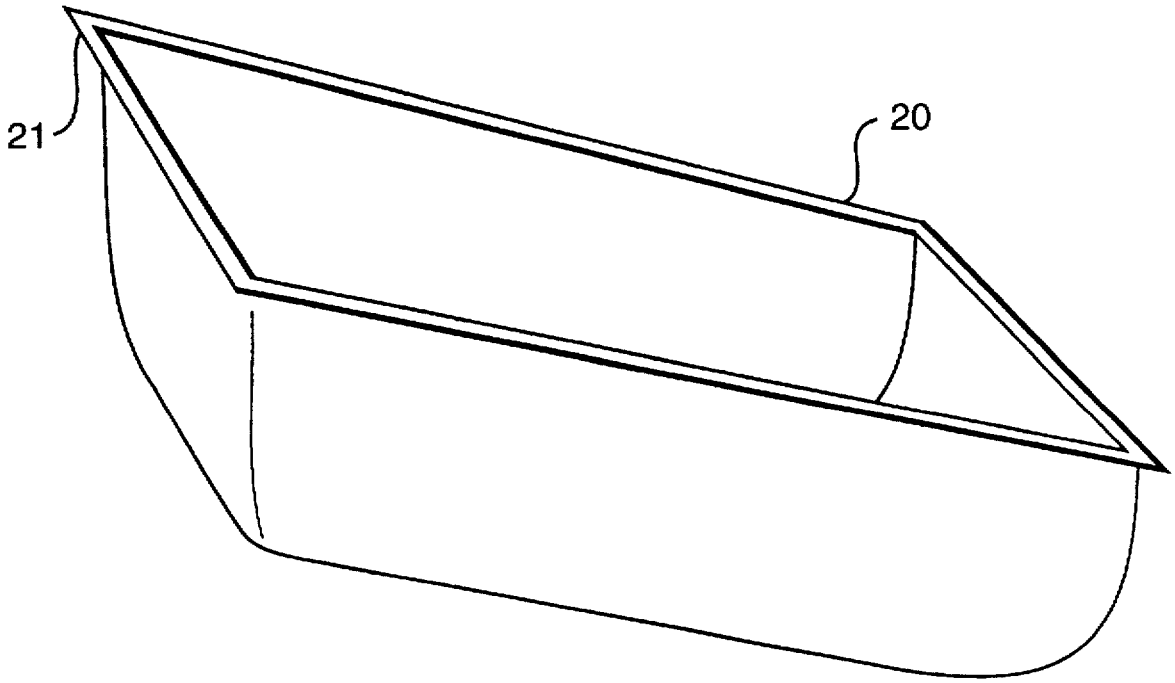
FIG. 1 illustrates the transportation tub.

Turning now to the drawings, FIG. 1 shows a transportation tub 20 which carries components-in-progress between work centers, beginning with raw materials, and ending with a finished component, such as a shirt front. The preferred tub dimensions (for apparel products, such as shirts and jeans) be approximately 20"×20"×5", with a lip 21 (of less than 1") along the top, as shown in FIG. 1. These dimensions, of course, may vary, depending on the type and dimensions of the end-products to be manufactured.

A tub carrier (not shown), transports multiple tubs 20 between work centers. The tub carrier holds each tub in place via a series of flanges, such that each tub's lips 21 fit on top of the tub carrier's flanges.

Figure 2:
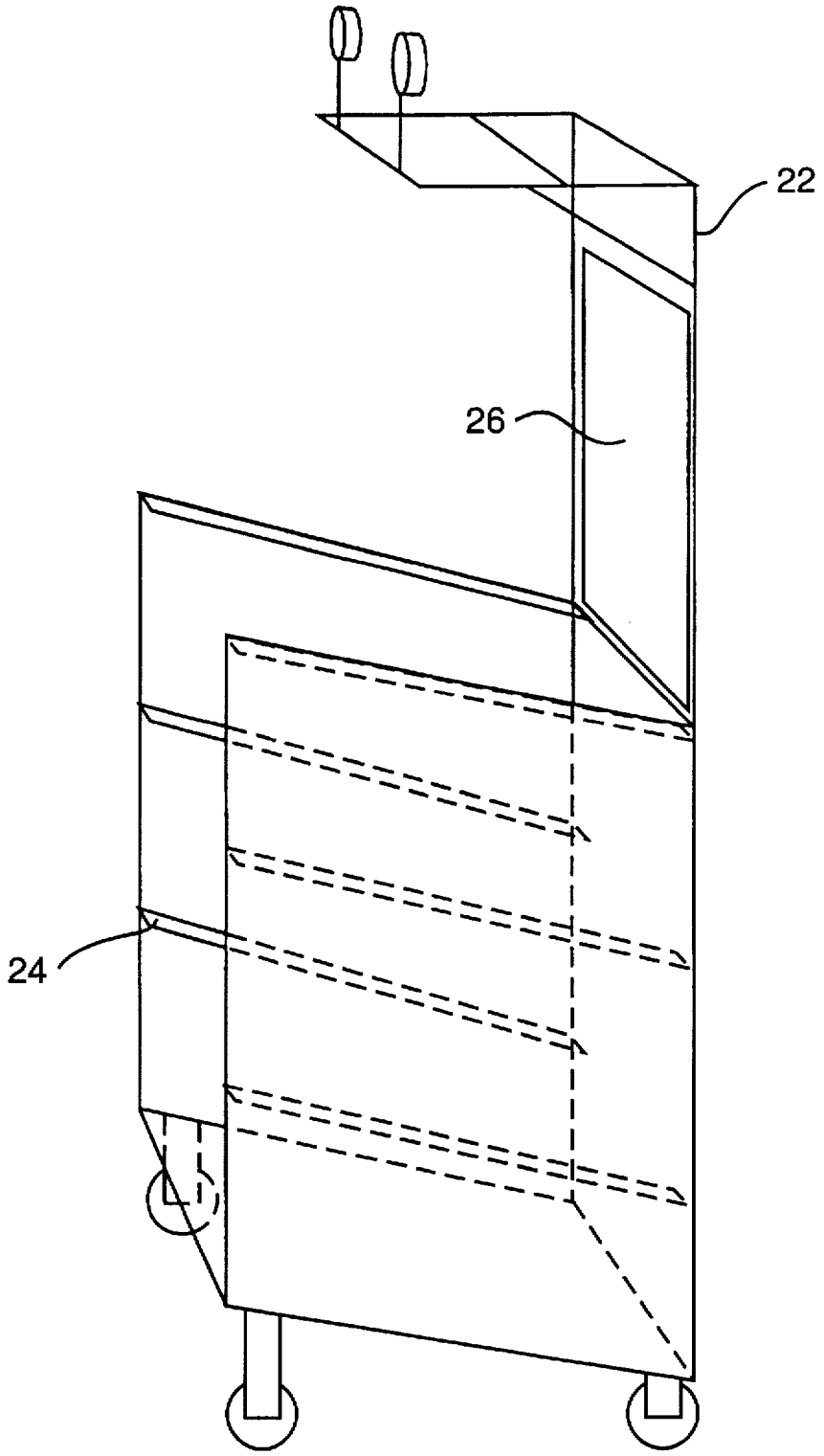
FIG. 2 illustrates the transportation cart.
Figure 3:
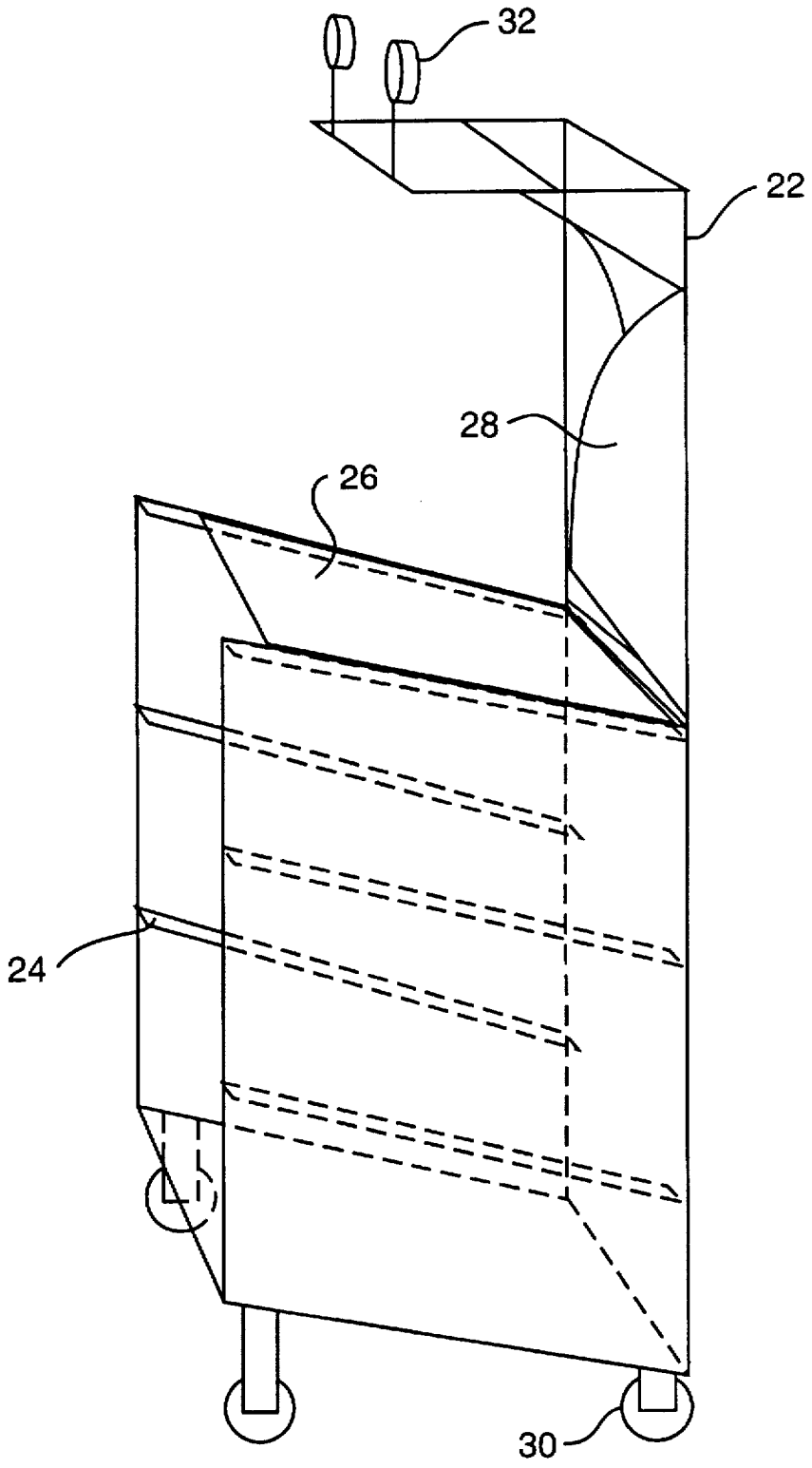
FIG. 3 shows the transportation cart of FIG. 2 with a foldable shelf swung down to form a table.

Transportation carts 22 carry subassemblies-in-progress between work centers, beginning with finished components, and ending with a finished product, such as a shirt. Transportation carts 22 also store raw materials, when the cart initially enters the manufacturing system, and are specially designed to store work-in-process in a variety of forms (e.g., folded, hung, or simply lying unfolded). The cart 22, as shown in FIGS. 2 and 3, contains a foldable shelf 26, two curved foldable arms 28, four bottom wheels 30, tow top wheels 32, and a series of flanges 24 to hold multiple tubs. The bottom wheels 30 allow the cart 22 to roll on the floor of the manufacturing system. The top wheels 32 allow the cart 22 to be transported (possibly suspended), by a system of trolleys.

Figure 4:
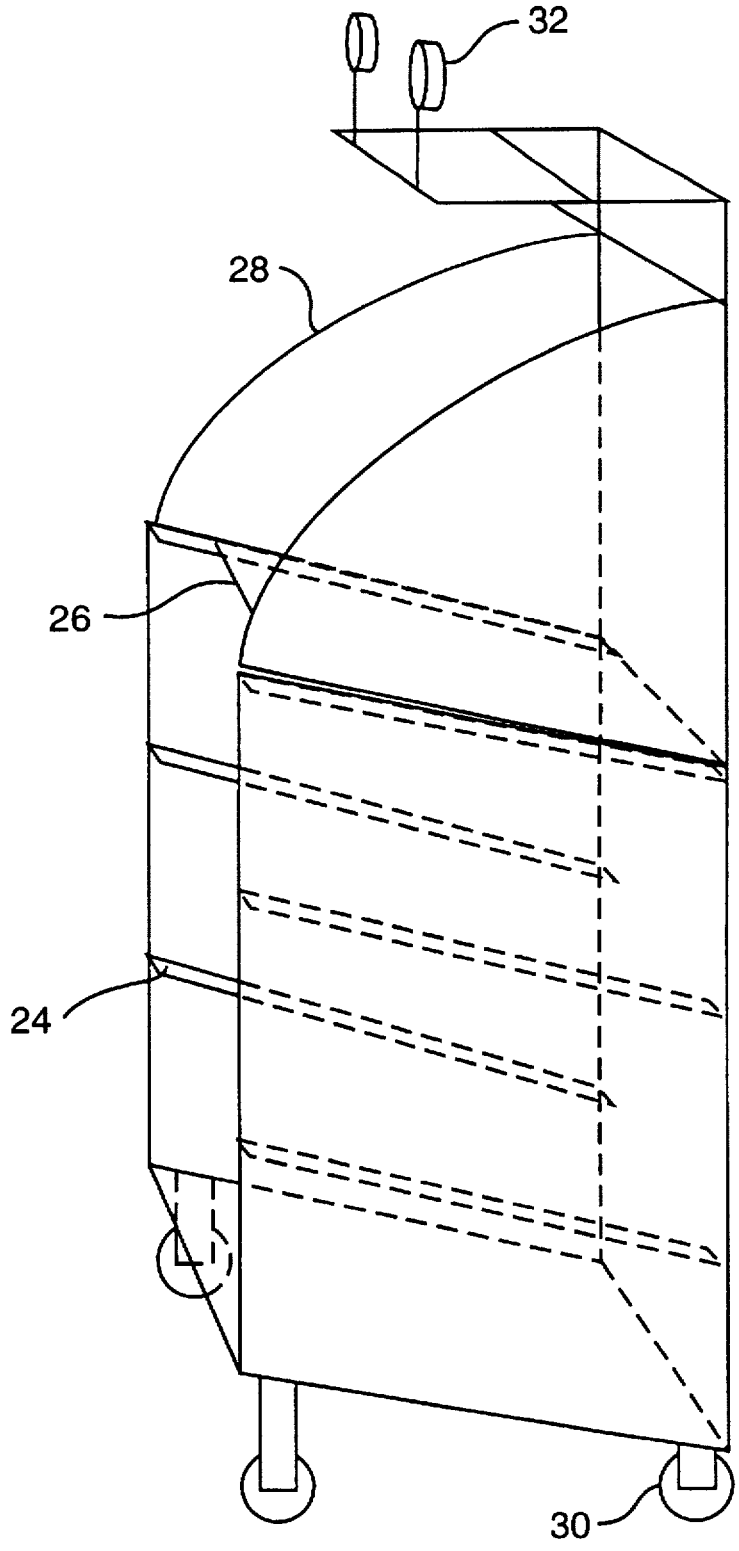
FIG. 4 shows the transportation cart of FIG. 2 with a foldable shelf and foldable arms swung down, to form an enclosed compartment.

When the folding shelf 26 swings down (FIG. 3), it becomes a table that may contain work-in-process that may hang over the sides of the table. When the folding shelf 26 remains up (FIG. 2), the cart 22 is capable of containing long garments that are hung on hangers. When the folding arms 28 also swing down, as shown in FIG. 4, a closed compartment results, that will not drop its contents (which might either be folded, hung, or simply lying unfolded) if the cart 22 is swung (the compartment's table is slanted upward, which also prevents the compartment from dropping its contents). Preferably, the folding arms 28 are curved because this makes the cart 22 easier to maneuver, without sacrificing the protection that the arms provide to the items (e.g., hanging items) transported by the cart, but the arms could be of any shape that would provide an enclosed area.

Figure 5:
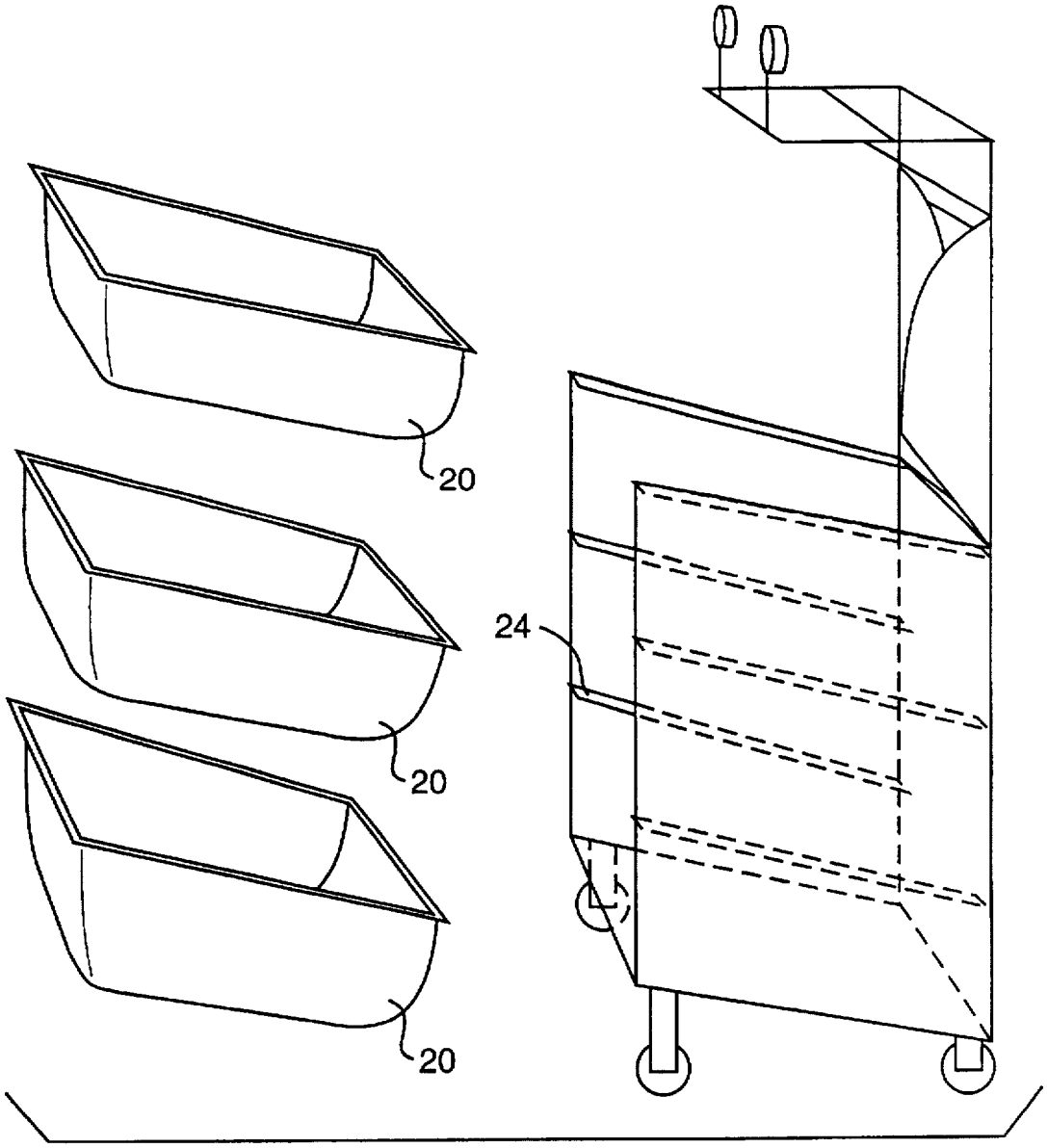
FIG. 5 shows that the transportation cart of FIG. 2 multiple tubs.
Figure 6:
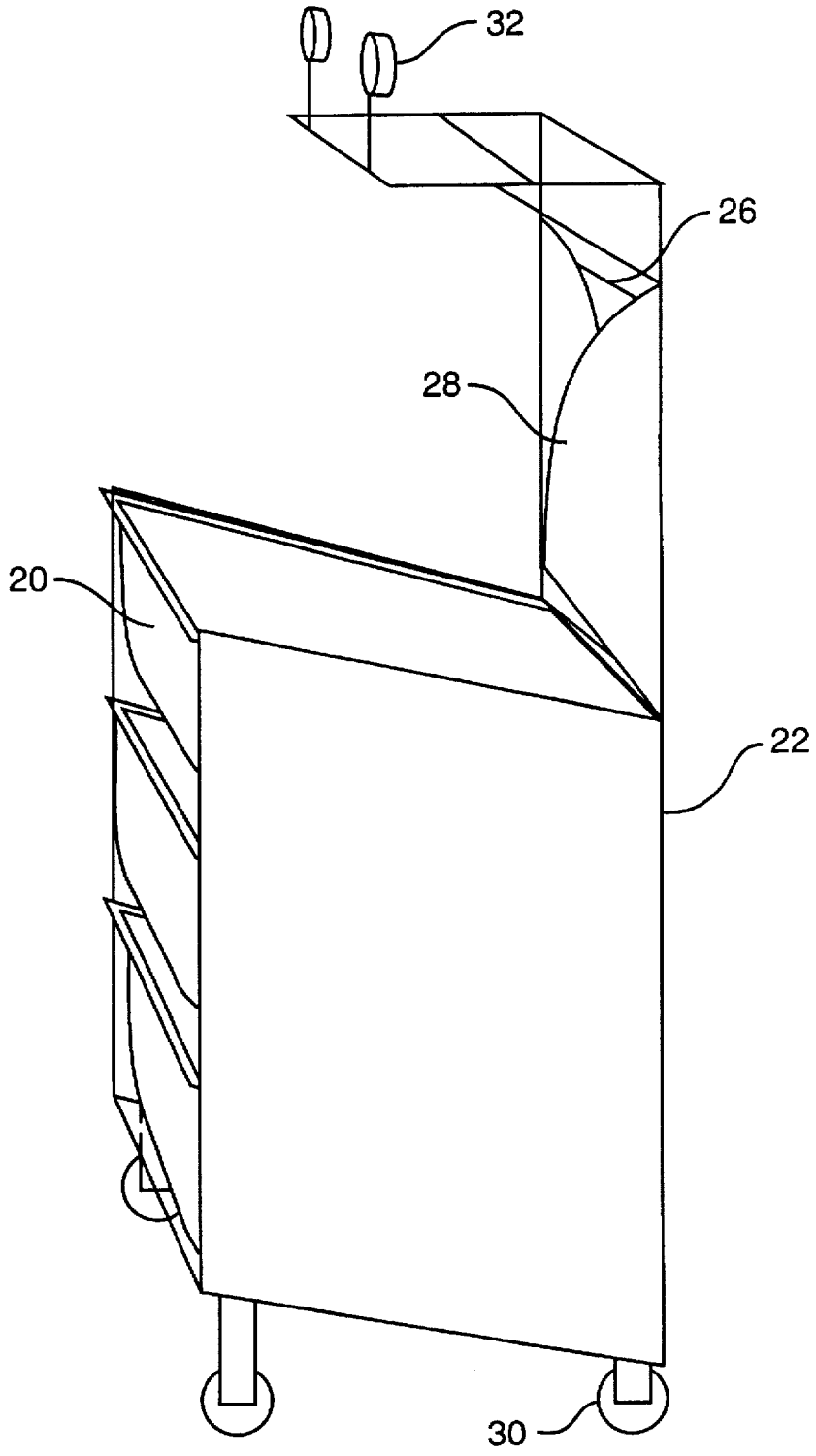
FIG. 6 shows the transportation cart of FIG. 2 with multiple tubs inserted.
Figure 7:
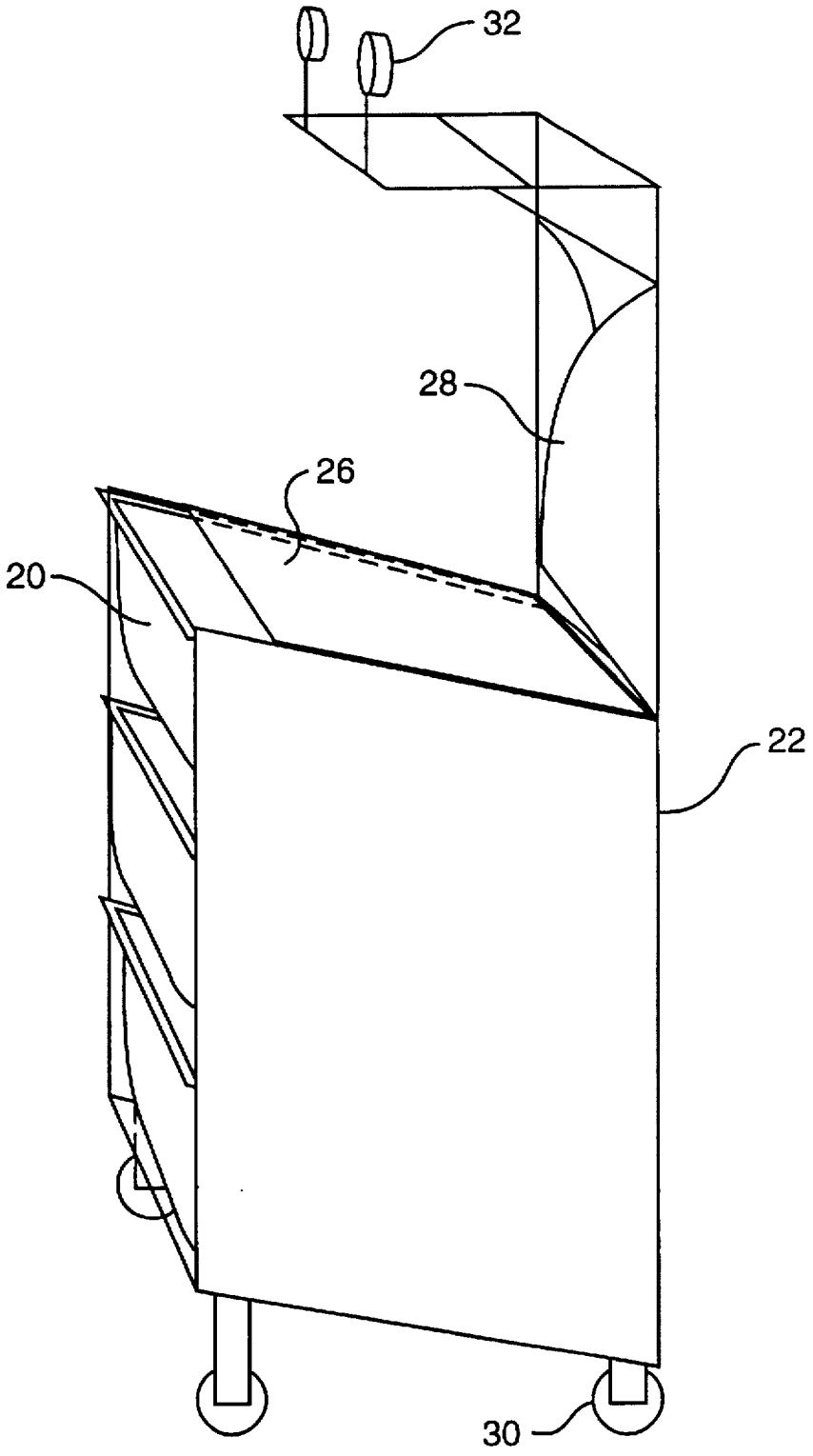
FIG. 7 shows the transportation cart of FIG. 2 with its foldable shelf swung down, to enclose the contents of the topmost tub.

As shown in FIGS. 5, 6, and 7, a series of tubs 20 may be inserted into the cart 22. The cart's sides contain a series of flanges 24, where a pair of flanges on opposite sides of the cart 22 holds each tub in place (the tub's lips 21 fit on top of the cart's flanges 24). The flanges 24 used to hold tubs 20 in place are slanted, so that tubs will not drop their contents if the cart is suspended and swung.

Each tub may contain two distinct sets of work-in-process items (e.g., one set in the right side of the tub, the other set in the left side), without requiring these items to be explicitly bundled. As shown in FIG. 7, the topmost tub may be enclosed (to avoid dropping its contents) by swinging the folding shelf 26 down.

The number of flanges 24 on the sides of the cart determines the maximum number of tubs 20 that can be carried by the cart. This number will depend on the maximum number of components comprising a garment to be produced by the manufacturing system. If necessary, tubs of varying sizes may be used.

The dimensions of cart 22 may vary, depending on the dimensions of the tubs to be held by the cart, as well as on the dimensions of the end-products to be manufactured. Optimal cart dimensions also depend on whether workers are sitting or standing (e.g, if workers are sitting, then it may be desirable to dimension the carts so that workers do not need to stand in order to reach the items on the cart). It would also be desirable to dimension carts so that items may be sewn while still on the cart, rather than requiring items to be removed from the cart in order to be sewn.

System Architecture

Figure 8:
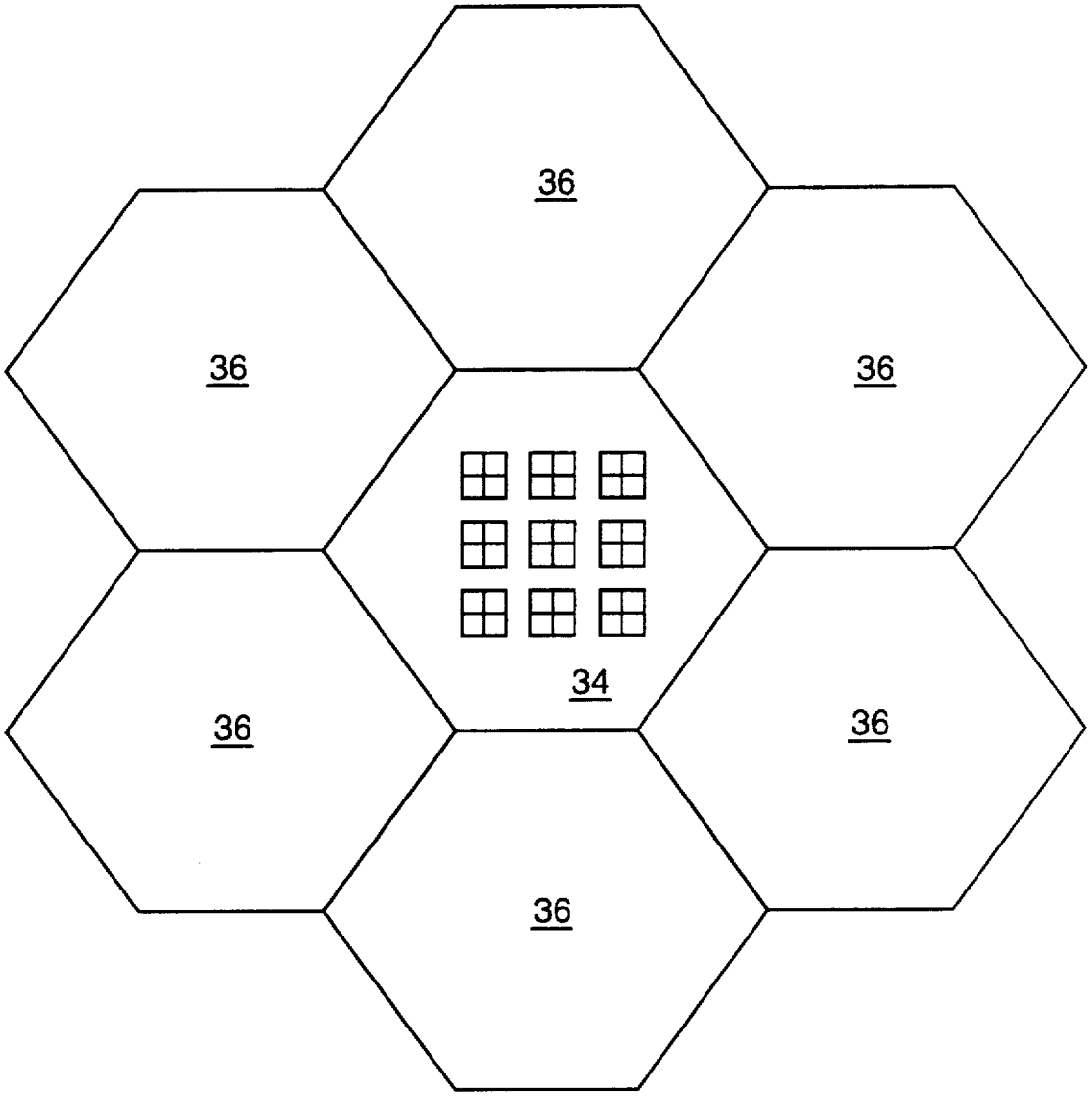
FIG. 8 illustrates the basic manufacturing system layout, with a circular floor, a central staging area, and six hexagon-shaped work centers placed around the perimeter.

As shown in FIG. 8, the basic manufacturing system layout has a circular floor, with a central staging area 34, and six hexagon-shaped work centers 36 placed around the perimeter of the central staging area. There is a work center for each of the five skilled operations, and a work center for the two un-skilled operations.

Figure 9:
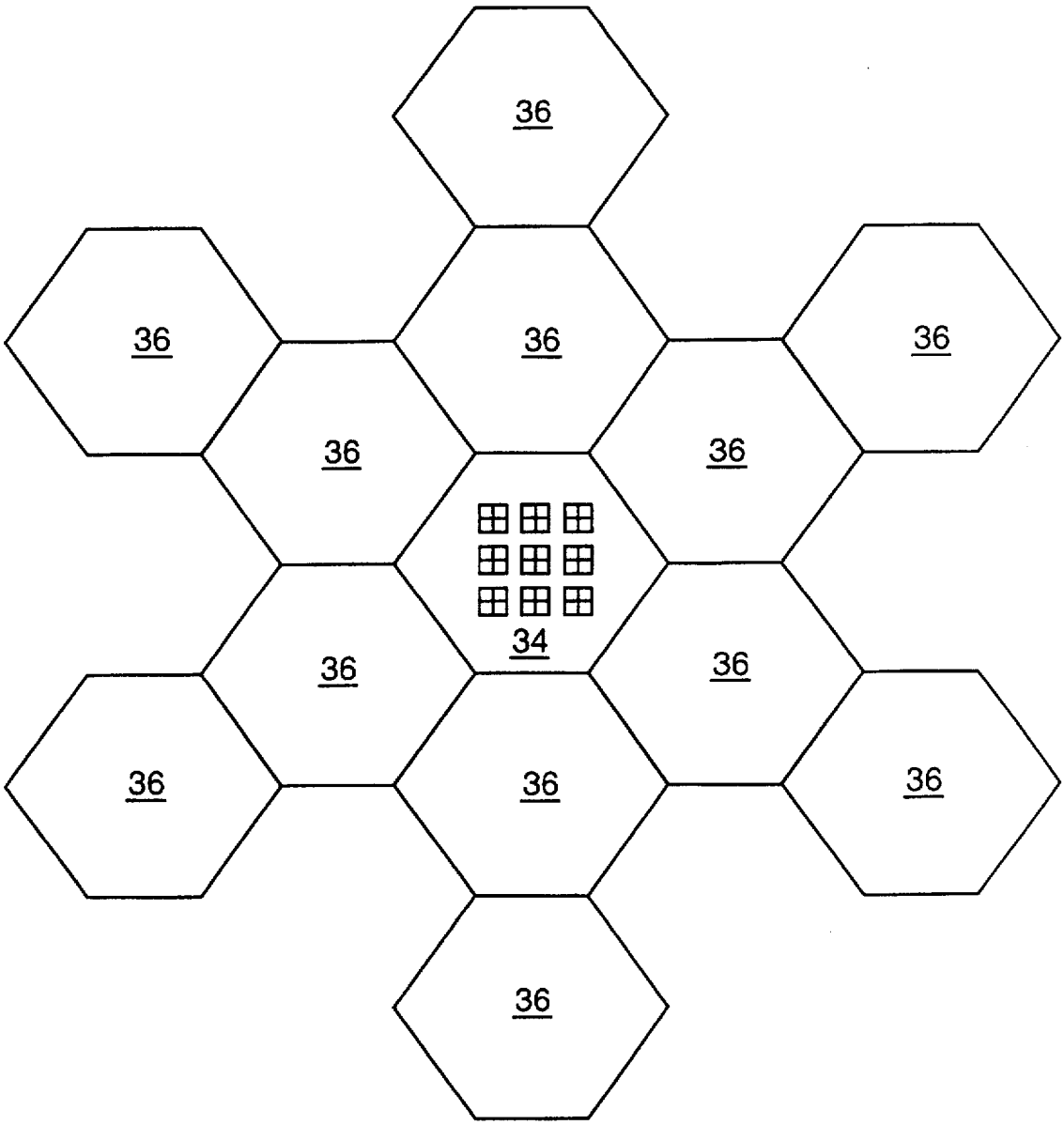
FIG. 9 shows how the basic manufacturing system layout accommodates expanded work centers.

FIG. 9 shows how the basic layout accommodates expanded work centers 36. The hexagonal layout is optimal because the hexagon is the largest polygon that is able to "tile", or fully cover a two-dimensional plane, while maximizing the size of the work center perimeter, in order to afford greater flexibility of traffic patterns, as tub carriers travel between work centers, without crossing the interior of any work center (as described below).

Figure 10:
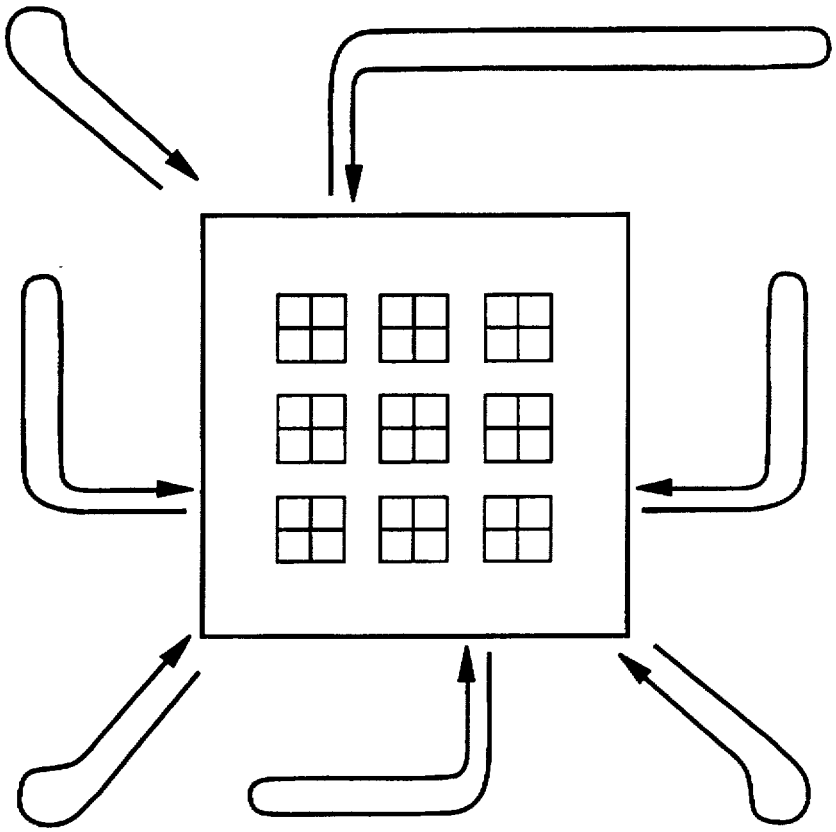
FIG. 10 illustrates an alternative manufacturing system layout, with a circular floor, a central staging area, and seven rectangle-shaped work centers placed around the perimeter.

Rectangular and triangular layouts are also possible, but would result in a lower ratio of the length of each side, to the length of the total perimeter, thereby reducing the relative size of the work center perimeters (and therefore the area available as tub queues, as discussed later). However, sometimes an alternative layout might be desirable, if there are other constraints on the manufacturing system (such as the need to reduce total space, rather than total perimeter length). In addition, the geometry and size of the machines in the work centers might make other configurations more desirable. The alternative layout, with seven rectangular-shaped work centers 36 (corresponding to the five skilled operations and the two un-skilled operations) placed around the perimeter, as shown in FIG. 10, might be selected to reduce the overall space of the manufacturing system.

Figure 11:
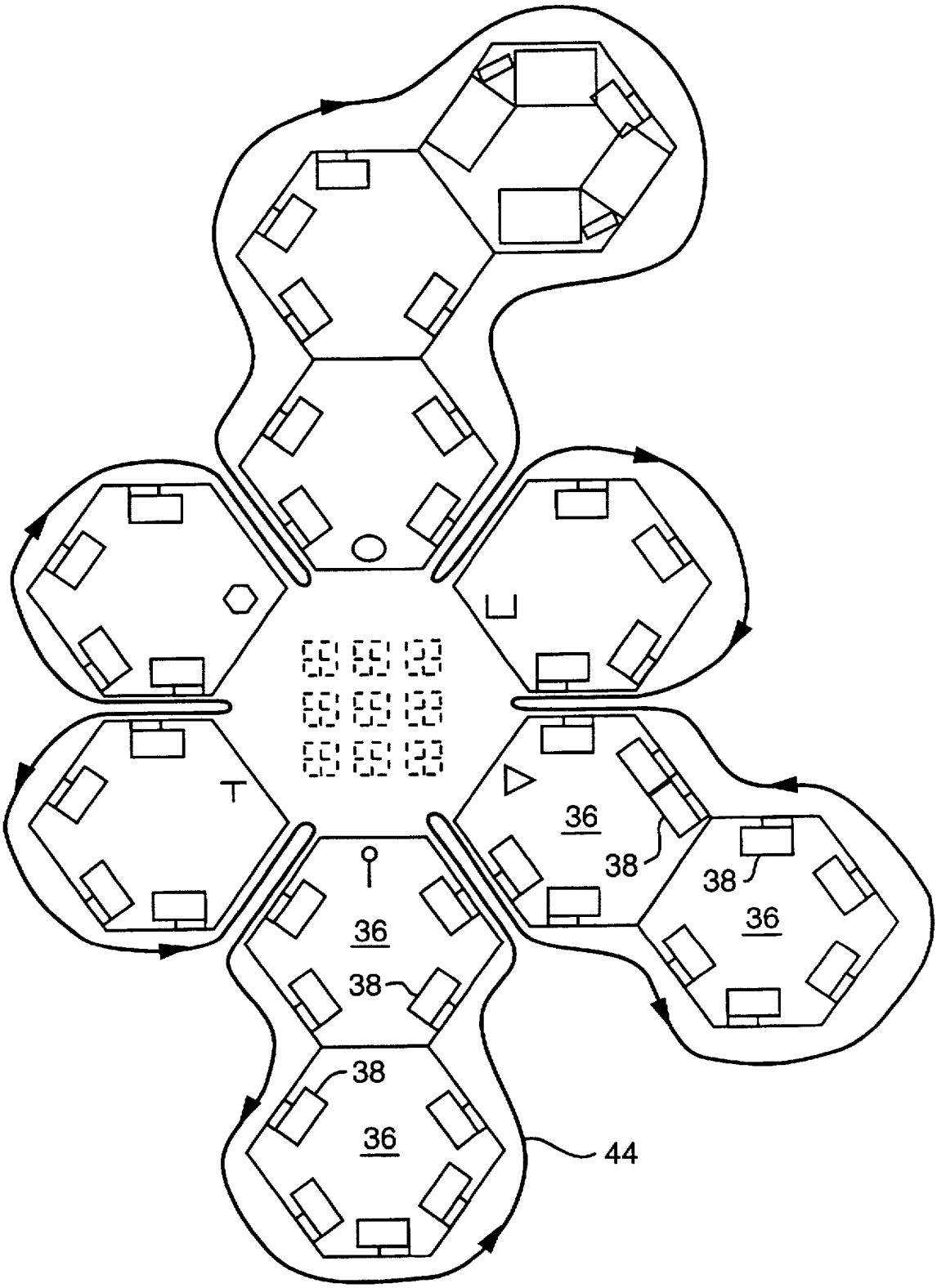
FIG. 11 shows multiple machines and tub queues within work centers, as well as the route traveled by tub carts, as they visit each work center.
Figure 12:
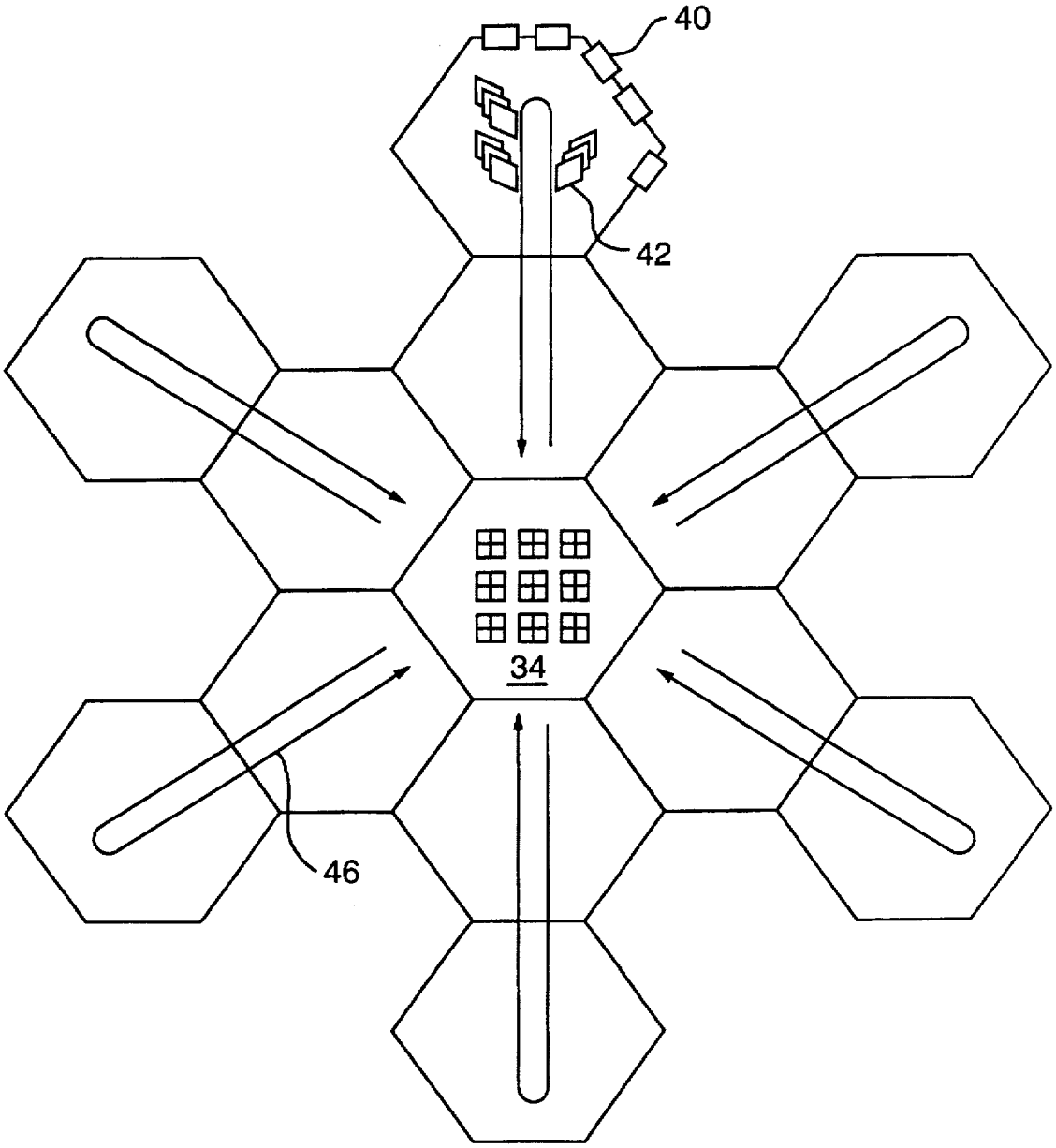
FIG. 12 shows the tub and cart queues, as well as the route traveled by carts, as they travel between work centers and the central staging area.

Each work center 36 contains one or more machines 38 for performing operations, as shown in FIG. 11. Machines 38 are located near the perimeter of each hexagonal work center. As shown in FIG. 12, there are two work-in-process queues associated with each machine: a tub queue (chute) 40 and a cart queue 42. Tub queues 40 contain components at various stages of manufacture, and are located near the perimeter of the work center, in close proximity to tub carrier routes 44, as shown in FIG. 11. Cart queues 42 contain subassemblies at various stages of assembly, and are located in the interior of the work center 36, in close proximity to cart routes 46, as shown in FIG. 12. The cart queue 42 is simply a group of tub carts 22 located in the interior of the work center 36. The tub and cart queues may be shared among multiple machines (as shown in the topmost hexagon in FIG. 11), if the number of workers is less than the number of machines. For example, if there is only one worker in a given work center, there should be only one active cart queue 42, and only one active tub queue 40, regardless of the number of machines.

In order to simplify traffic patterns (and prevent traffic accidents), when carts move between work centers 36, they must travel via the central staging area 34, as shown in FIG. 12. Traffic aisles within a work center 36 are uni-directional (one-way streets), as shown in FIG. 12. The cart 22 move toward the central staging area 34 on one aisle, and away from the central staging area 34 on the opposite aisle.

Once carts reach the central staging area, they travel on uni-directional traffic routes along its circumference, taking a short-cut through the diameter of the central staging area, if necessary, to reduce the length of the route through the central staging area. Workers that push the carts through said routes may traverse a "figure-eight", while transporting carts between work centers.

Each set of work centers 36 has one or more associated tub carriers (not shown) for transporting tubs between work centers 36. The tub carriers could be any type of carrying device on wheels that is big enough to hold tubs 20. Each tub carrier travels a "figure-eight" path 44, as it visits the perimeter of each of the six work centers 36 in succession, in close proximity to the tub queues (racks) 40, as shown in FIG. 11. This path 44 includes visits to the central staging area, either to pick up tubs 20 from parked carts 22, or return tubs 20 to carts 22 or their designated parking spaces. The key constraint is that, for a given set of work centers 36, each tub carrier traverses the perimeter of each work center (and makes at least one visit to the central staging area, as indicated in FIG. 13) on each cycle through the manufacturing system.

Figure 13:
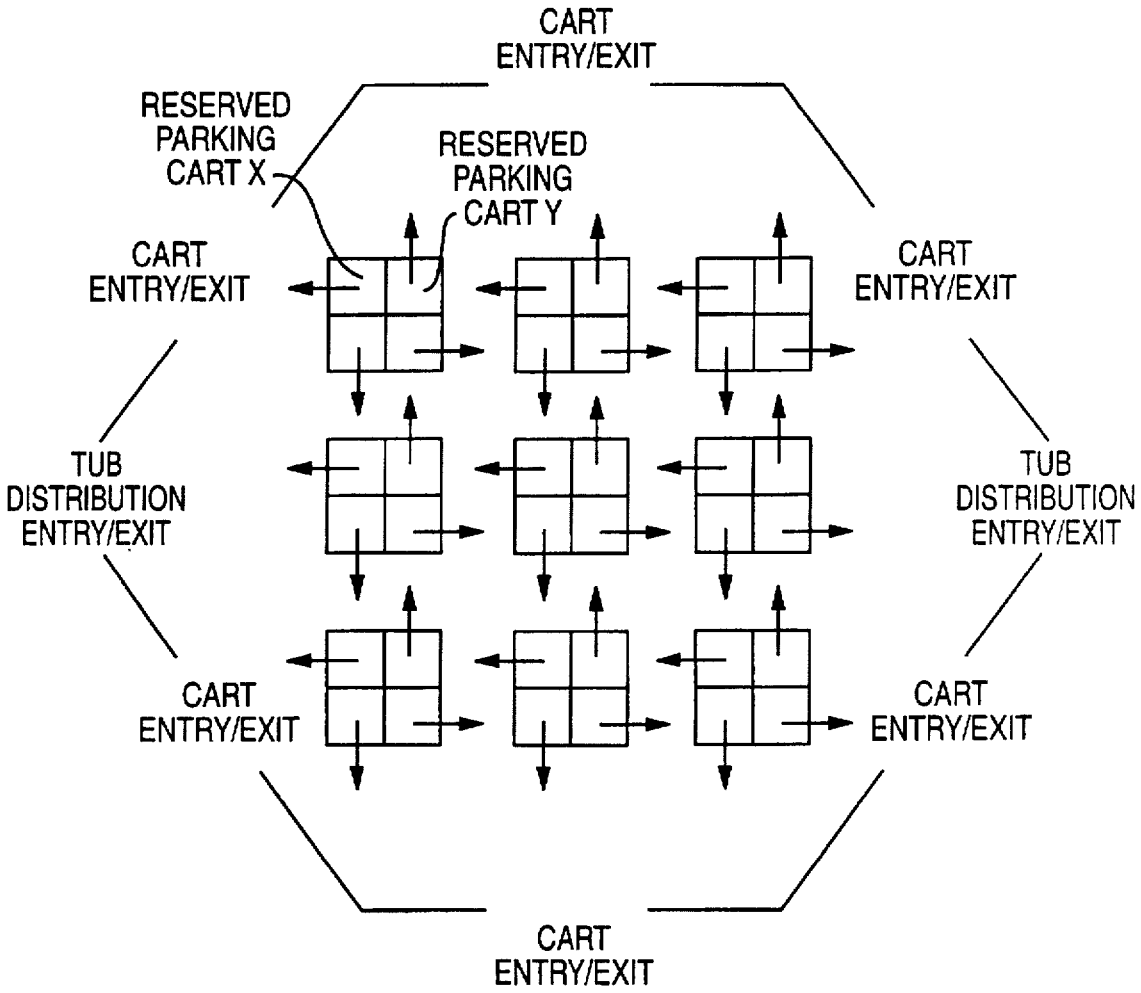
FIG. 13 shows the parking area within the central staging area, including constraints on a vehicle's direction of motion.

As shown in FIG. 13, the central staging area 34 includes a parking area for carts 22. The parking area consists of a set of labeled parking spaces, where the label of each parking space is the same as the cart's 22 (unique) label. The parking spaces are separated by aisles, which are traversed by carts heading to and from the parking area. (Parking spaces are square, rather than hexagonal, because hexagonal parking spaces would create crooked, difficult to navigate aisles.) Reducing the number of aisles also reduces the flexibility of cart movement. One extreme case occurs when there are no aisles whatsoever (all of the parking spaces organized as a single, large unit). Of course, in this case, some carts (e.g., in interior parking spaces) cannot move at all. The other extreme occurs when all parking spaces are separated by aisles, which provides maximum cart movement flexibility, where any cart could initially move in 4 directions (up, down, right, or left). In this case, the number of aisles would be equal to the number of parking rows plus the number of parking columns. However, organizing parking spaces into quads still allows sufficient cart movement flexibility, and cuts the number of aisles in half. FIG. 13 shows how, in the preferred embodiment, the initial movement of each parked cart is restricted to a single direction, in order to guarantee that all parked carts can simultaneously make their initial moves without interference from other carts. Note that if parking areas were organized into a configuration more than two parking spaces thick, then all parked carts would not be able to simultaneously move.

Figure 14:
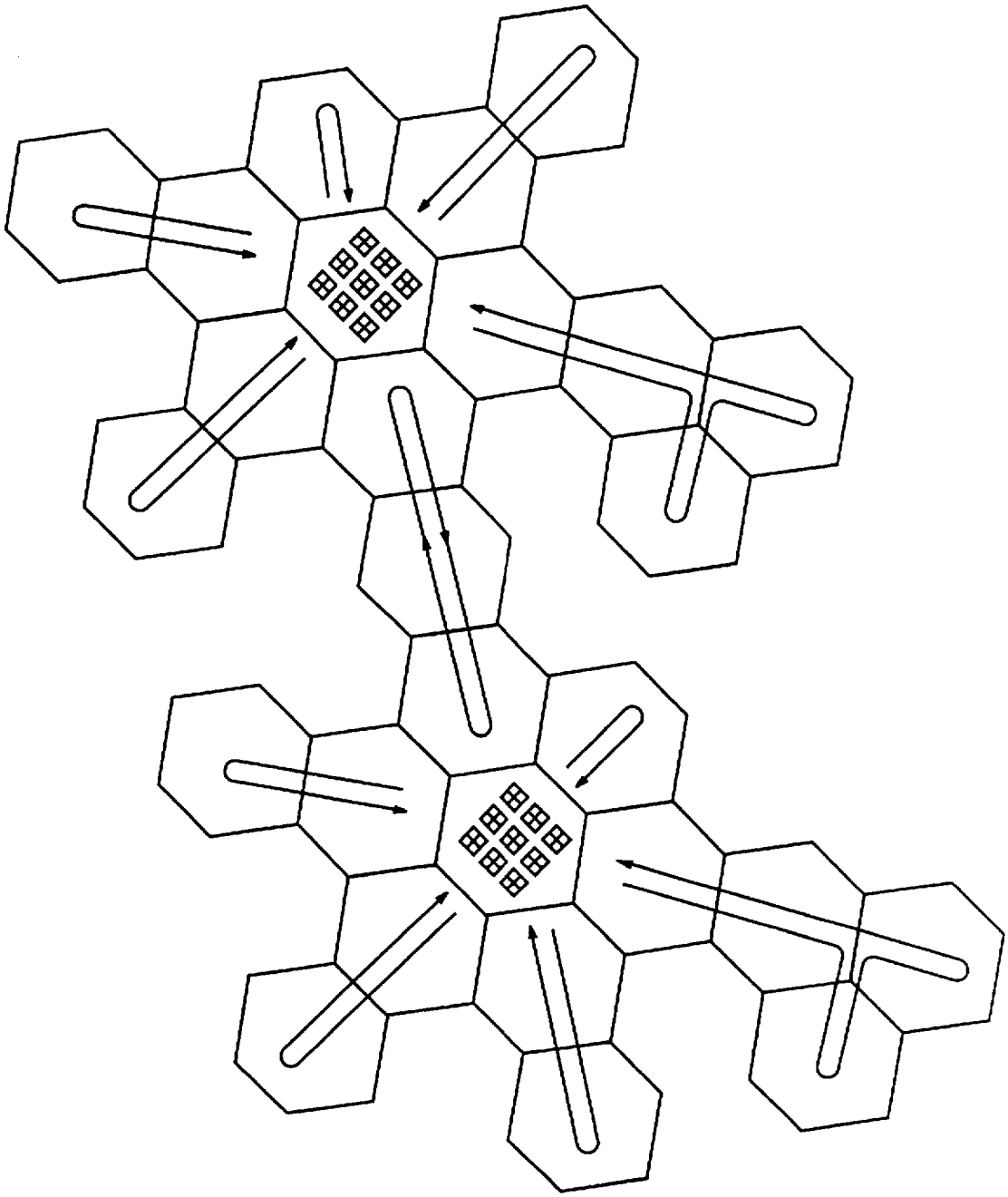
FIG. 14 shows the basic (hexagonal) manufacturing system layout expanded to include multiple sets of six hexagonal work centers, where these different sets may share common work centers.
Figure 15:
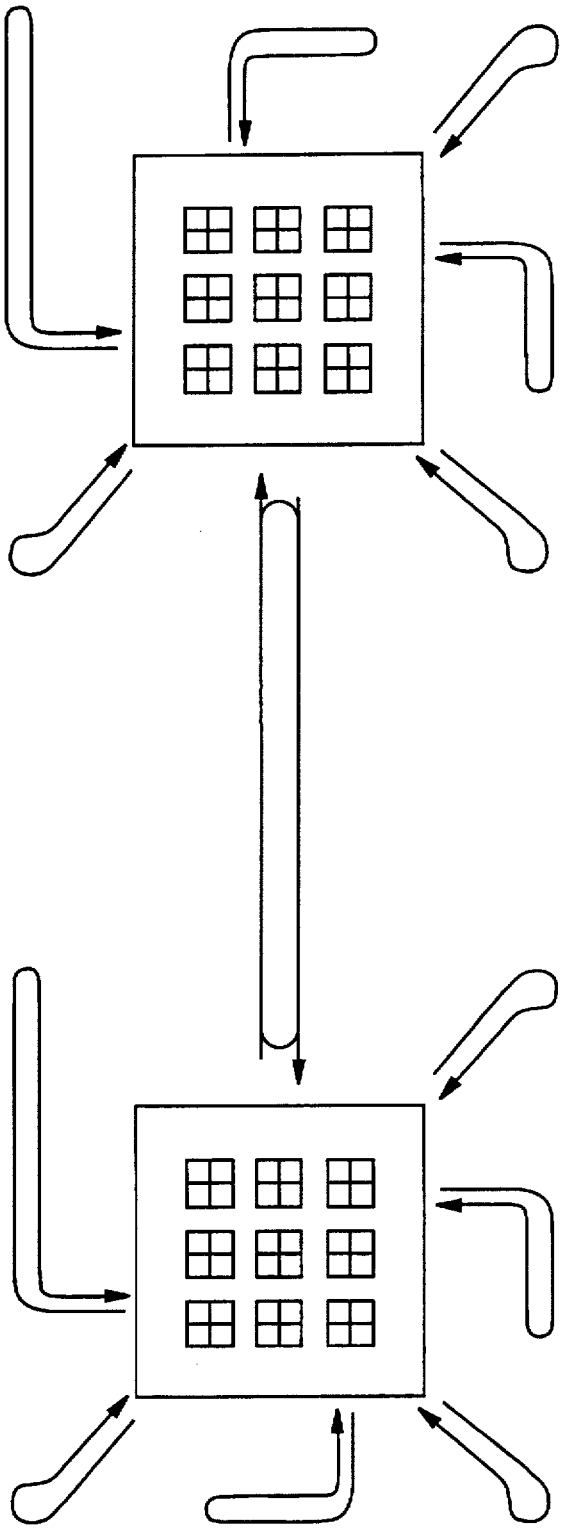
FIG. 15 shows an alternate (rectangular) manufacturing system layout expanded to include multiple sets of seven rectangular work centers.

The basic manufacturing system layout may be expanded to include multiple sets of the six hexagonal work centers 36, where these different sets may share some common (possibly expanded) work centers (see FIG. 14). Similarly, the alternate manufacturing system layout may be expanded to include multiple sets of the seven rectangular work centers 36 (see FIG. 15). FIGS. 14 and 15 show that within the shared work centers, the same (unidirectional) traffic aisles may be used by all carts traveling to or from either central staging area. When a cart moves from a shared work center to the next work center specified in its instruction ticket, the cart always travels via its home central staging area (or the central staging area that contains the cart's labeled parking space). Decisions relating to the number of sets of work centers, as well as when to share work centers among sets, depend on the desired cycle time per work center (the smaller the work center, the quicker its cycle time). (An analysis of work center loading patterns would be useful in guiding this decision-making process.)

System Operation

The manufacturing system operates as follows:

1) Initial Loading: Raw materials enter the manufacturing system in carts 22, which are parked in the center staging area 34. Each cart 22 contains batches of raw materials to be manufactured into finished components (one incoming batch might contain the raw materials for shirt sleeves, or shirt fronts, etc.).

There may be multiple carts corresponding to each product line. For example, a product line might consist of 2000 units, and each cart might contain a batch of raw materials corresponding to 16 units. The first cart in each product line will contain specially marked tubs. Successive carts will contain unmarked tubs.

2) Component Manufacturing: Tubs 20 visit (via tub carriers 20) a succession of work centers 36 via tub carrier paths 44, as the raw materials batches are converted to finished components. Each tub 20 carries an instruction ticket, which specifies the series of work centers 36 to be visited by the tub 20, and the operations to be performed at each work center 36 (including consolidation operations). Tubs 20 also contain any additional materials needed for their component-manufacturing operations, such as thread.

In order to minimize setup time and cost, the worker transporting the tub carrier should drop off the tub 20 at a machine (within the work center 36 specified on the instruction ticket) that is already set up to perform the next operation (specified on the instruction ticket). If there are multiple such machines, then the least busy machine (i.e., the machine with the smallest tub queue) should be selected. If there is no machine already set up for the next operation (e.g., a specially marked tub corresponding to the first batch of raw materials for a new product line), then the worker should simply drop off the tub 20 at the least busy machine.

When a specially marked tub moves to the front of the machine's tub queue, then the worker operating that machine may switch to another machine, until the first machine has been setup for the new operation. The setup might be performed by a worker that specializes in machine setups, who patrols the work centers, checking for setups that need to be performed, which are indicated by the presence of the specially marked tub at the front a tub queue.

Batches of finished components are placed back on the cart 22 (which is still parked in the center staging area). There is never any need to perform additional packaging or "bundling" of raw materials, work-in-process, or finished products, since the same cart 22 will contain the initial raw materials, intermediate work-in-process, and finished products (all corresponding to the initial batch of raw materials). Component-manufacturing operations may proceed concurrently (e.g., shirt fronts may be manufactured concurrently with shirt backs, sleeves, etc.).

There will inevitably be some defects during component manufacturing, resulting in work-in-process that falls below acceptable quality thresholds. Once a defective work-in-process item is discovered, it is specially marked, and placed on the top of the batch of items contained in the tub. Defects are processed by prefixing additional operations to the tub's instruction ticket, where these additional operations will either undo or discard the defect, as necessary. In either case, the result will be a defect-free batch of work-in-progress items, whose processing can now proceed normally. Defects are undone at the work center for unskilled operations.

3) Assembly: Once the cart 22 is full (i.e., the cart 22 contains all of the finished components corresponding to its original batch of raw materials), then the cart 22 visits a series of work centers 36, via paths 46, where successive assembly operations will be performed. Each cart 22 carries an instruction ticket, which specifies the series of work centers 36 to be visited by the cart 22, and the assembly operations to be performed at each work center. Note that when carts 22 move between work centers 36, they must travel via the central staging area 34. Carts 22 also contain any additional materials needed for their assembly operations (e.g., thread). Assembly operations must be performed sequentially, as the cart 22 visits each successive work center 36.

Assembly defects are handled in a manner similar to component manufacturing defects. That is, assembly defects are marked, additional instructions are prefixed to the cart's instruction ticket, etc.

4) Shipping: Once assembly is complete, the cart 22 exits the manufacturing system, and waits at a shipping area.

After unloading its finished products at the shipping area, the cart 22 proceeds to a loading area, awaiting a new batch of raw materials and instruction tickets.

The use of labeled parking spaces in the central staging area allows assembly operations to begin before all components are manufactured (assuming that some assembly work can be performed without requiring the presence of all finished components). The idea is to instruct the cart 22 (via its instruction ticket that determines its path through the manufacturing system) to later return (after assembly has begun) to its designated parking space to pick up the "late" finished component.

In addition, some finished components may be consolidated together, before being placed back on the cart (according to the instruction tickets carried by the relevant tubs and carts):

1) Finished components to be consolidated return to the cart's parking space (in the central staging area), where they are consolidated into a single tub (instead of being immediately loaded onto the cart).

2) This tub then visits (via a tub carrier) appropriate work centers to assemble these components into a simple subassembly. Only simple subassemblies are allowed, since the tubs cannot carry work-in-process in arbitrary forms.

3) When the subassembly is completed, the tub is returned to the cart's parking space.

4) The subassembly is then either directly loaded on the cart, or, if the cart has already embarked on its assembly route, the subassembly will wait to be picked up by the cart when the cart returns to the central staging area.

5) The cart completes the remainder of its assembly operations.

Using labeled parking spaces also allows bulk manufacturing of components (e.g., manufacturing with large lot sizes). For example, assume that each cart contains the raw materials for N garments, and that it is more efficient to manufacture a particular component, such as pockets, in bulk. One cart P could contain the pocket raw materials for many more than N garments (e.g., 10N, 50N, 100N, etc. garments), while other carts would not contain any raw materials for pockets. Some finished pockets would be delivered back to cart P (so that P may assemble these pockets onto its N garments), while others would be stored (in one or more tubs) in cart P's parking space, to be later picked up by other carts requiring pockets (as specified in the appropriate cart instruction tickets).

Traffic Algorithm (for the Central Staging Area)

When a vehicle (either a cart or a tub carrier) travels in the parking area (see FIG. 13), it will traverse a series of steps within the parking aisles. All aisles are unidirectional, or one-way. (Bi-directional, or two-way aisles would allow more flexible cart travel, but would double the aisle space. In addition, bi-directional aisles are not needed to prevent deadlock, as is discussed in the next section.) Vehicles may proceed within an aisle, or turn into intersecting aisles.

Intersection-crossing and turning are atomic. That is, when a vehicle crosses an intersection or turns into an intersecting aisle, the vehicle will have completely traversed the intersection before another vehicle comes to the same point in the central staging area. Thus, vehicles will no be left waiting in the intersections.

A vehicle may traverse an adjacent step if the step is empty (or will be empty on the following time unit). If two vehicles simultaneously compete to traverse the same step, then the conflict is resolved according to the following protocol:

the leftmost vehicle yields to the rightmost vehicle however, if the leftmost vehicle has already yielded to a previous vehicle, then the rightmost vehicle yields to the leftmost vehicle.

Deadlock Prevention

Deadlocks occur when no vehicle is able to move, due to blocked parking aisle intersections. However, deadlock configurations cannot be reached with the present invention, since aisle intersections are always kept clear. Vehicles will never wait at (and therefore block) an aisle intersection. Vehicles always make progress along their route, possibly waiting one time unit for a competing vehicle, before traversing each step.

Storage Areas for Work-in-Process

The tub queue 40 is a first-in-first-out (FIFO) queue, which may be implemented in a number of ways. We disclose a particular design for tub chutes that is simple and easy to use. (Other possible designs could be based on a "circular" system of shelves, where a pointer to the head of the queue is maintained, or a system of conveyors.)

Figure 16:
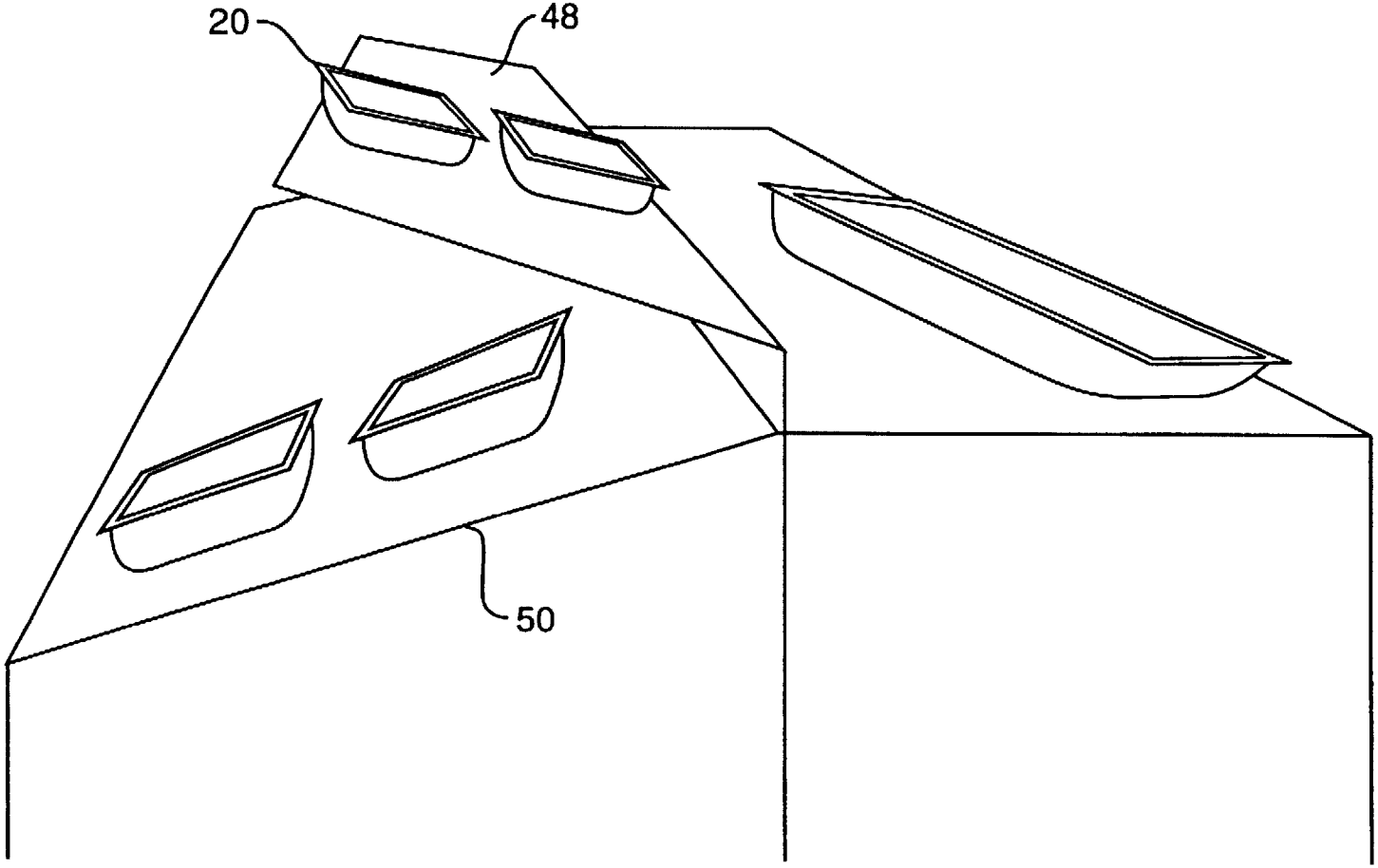
FIG. 16 illustrates the tub queue.

As shown in FIG. 16, the tub queue 40 consists of two slanted chutes 48 and 50. Incoming tubs (containing a batch of components-in-progress) are loaded into the top chute 48, and outgoing tubs are released via the bottom chute 50 (outgoing tubs are to be transported to the next work center, or the center staging area, as indicated on the instruction ticket). When a tub 20 is loaded into the queue, the tub slides down the chute, and is stopped either by a ridge at the bottom of the chute (if the chute is empty), or another tub (if the chute already contains one or more tubs). When the worker is ready to process the contents of the tub 20, he or she lifts the tub (not much force should be required), and the tub 20 will fall onto the surface (e.g., on a table that is near a machine) used by the worker. When the worker has finished with the tub's contents, he or she simply loads the tub 20 onto the bottom chute 50, which should also be adjacent to the working surface. If either tub chute ever becomes full, tubs may be stacked on top of each other.

The cart queue 42 is a simple linear queue. The cart queue 42 always has lower priority than the tub queue 40 (i.e., the cart queue 42 is processed only if the tub queue 40 is empty).

Self-Scheduling Work-in-Process Queues

The tub and cart work-in-process queues will be self-scheduling (without the need for external scheduling), providing the following constraints are satisfied:

1) At each work center 36, the tub queue 40 dominates the cart queue 42. That is, if the tub queue 40 is non-empty, then the tubs in the queue are processed. The cart queue 42 is processed only if the tub queue 40 is empty.

2) The number of carts 22 is fixed, for a given level of manufacturing system capacity. (Of course, the number of carts may need to be adjusted as the capacity of the manufacturing system and its work centers expands or shrinks.)

We illustrate the self-scheduling nature of the work-in-process queues by examining how these queues grow and shrink over time. Queues grow as new work-in-process arrives at a work center, and must wait in a queue before being processed; queues shrink as work-in-process is removed from a queue, to be processed by the work center. As the manufacturing system operates, the tub and cart queues grow and shrink as follows:

1) Initialization: When the manufacturing system initially begins operation, both the tub and cart work-in-process queues will be empty.

2) Main Loop: Component manufacturing and assembly operations proceed concurrently.

a) Component Manufacturing—Tub Queues Grow: As new carts enter the manufacturing system, they bring new batches of raw materials to be manufactured into finished components, by visiting a succession of work centers, and waiting in the tub queues associated with those work centers. As long as a free, empty cart exists, new raw materials may be brought into the manufacturing system, and component manufacturing operations will continue (and tub queues will grow).

b) Assembly—Cart Queues Grow: Once a sufficient number of components is finished, assembly can begin, as carts, now containing finished components, visit a succession of work centers, and wait in the cart queues associated with those work centers.

Since cart queues have lower priority than tub queues, the size of the tub queues will decrease (while the size of the cart queues will increase), until the associated tub queues become empty.

3) Intrinsic Load Balancing Mechanism—Full Cart Queues Prevent Additional Component Manufacturing: In the extreme case, every cart in the manufacturing system will be waiting in some cart queue, waiting for some assembly operation to be performed. If all carts are busy, however, the flow of new raw materials will automatically be cut off, since new raw materials cannot enter the manufacturing system unless a cart becomes empty. Thus, a "feedback loop" between the cart queue and the tub queue turns off the flow of new raw materials entering the manufacturing system. (If a process has a feedback loop, once it reaches some threshold condition, the process reverses itself. For example, a thermostat automatically turns off a healing system once the desired temperature is reached.) This feedback loop requires the second constraint above, which requires the number of carts to be fixed. Otherwise, we cannot guarantee that the flow of new raw materials will be cut off (additional carts could bring new raw materials into the manufacturing system ad infinitum, until an external scheduler intervened to ensure that assembly operations are not indefinitely postponed).

When every cart 22 is waiting in a queue, no new component manufacturing operations are allowed (since no empty carts are available), preventing the further growth of tub queues 40. Eventually, tub queues 40 will become empty (as tubs 20 are processed, and components-in-process are finished), which allows the cart queues 42 to be processed. Once carts 22 complete their assembly operations, and deliver their goods to the shipping area, these (now empty) carts 22 will become available to bring new raw materials into the manufacturing system, thereby enabling component manufacturing to resume (as in the main loop above).

Of course, it should be understood that a wide range of changes and modifications can be made to the preferred embodiment described above. It is therefore understood that the foregoing detailed description be regarded as illustrative rather than limiting, and that it be understood that it is the following claims, including all equivalents which are intended to define the scope of this invention.

We claim:

1. A method for the continuous manufacture of apparel, comprising the steps of:

(a) providing a plurality of carts, each of said carts designed to hold a plurality of tubs and containing a cart instruction ticket indicating manufacturing steps for materials in said cart;

(b) providing a central staging area;

(c) establishing a plurality of work centers located around said central staging area, each work center containing a plurality of machines;

(d) providing a plurality of carriers for transporting tubs containing raw materials, component parts, and subassemblies between said plurality of work centers and said central staging area;

(e) assigning each of said carts a parking space in said central staging area;

(f) loading said carts with tubs containing raw materials and providing each tub with a tub instruction ticket indicating manufacturing steps for materials in said tub;

(g) loading said tubs containing raw materials onto tub carriers;

(h) routing said tubs to a succession of work centers, via tub carriers, according to instructions on said tub instruction ticket;

(i) converting the raw materials into finished components;

(j) returning said tubs containing said finished components to said carts in said central staging area;

(k) defining traffic patterns for carts to travel between work centers such that each said cart returns to the central staging area between each visit to a work center; and (l) routing said carts to a succession of work centers, via said cart traffic pattern, according to instructions on said cart instruction ticket; and (m) converting said finished components to assembled garments.

2. The method for continuous manufacture of apparel of claim 1, further comprising the step of providing a plurality of first-in-first-out tub queues and cart queues in each work center, said tub queue containing apparel component parts at various stages of manufacture and said cart queue containing subassemblies at various stages of assembly, wherein work in said tub queue has priority over work in said cart queue.

3. The method for continuous manufacture of apparel of claim 2, wherein said tub queue and said cart queue which is least busy in a given work center receives a next set of items to be assembled.

4. The method for continuous manufacture of apparel of claim 2, wherein the number of tub queues and cart queues in a given work center is determined by how many workers are located at the given work center.

5. The method for continuous manufacture of apparel of claim 2, wherein said tub queues are composed of top and bottom slanted chutes, where incoming tubs are loaded into said top chute and outgoing tubs are released via said bottom chute.

6. The method for continuous manufacture of apparel of claim 5, wherein ridges at the bottom of each chute hold tubs within said chute, wherein said top chute is suspended above a surface used by a worker, contents of said chute dropping onto said surface when a tub is lifted by said worker, and further wherein said bottom chute is adjacent to said surface, in order to facilitate loading of tubs into said bottom chute.

7. The method for continuous manufacture of apparel of claim 1, wherein each of said carts remains in said central staging area until each of said tubs containing raw materials that were originally loaded in each of said carts at step (f) are returned to said carts.

8. The method for continuous manufacture of apparel of claim 7, wherein contents of tubs which require similar manufacturing steps can be consolidated in a single tub before returning said tubs to said carts.

9. The method for continuous manufacture of apparel of claim 1, wherein said carts visit successive work centers as soon as sufficient tubs containing components parts are returned to said carts to begin assembly.

10. The method for continuous manufacture of apparel of claim 9, wherein said carts periodically return to said central staging area to pick up tubs waiting in each of said carts' assigned parking space.

11. The method for continuous manufacture of apparel of claim 1, wherein said tub carriers traverse the perimeter of each work center and make at least one visit to said central staging area on each visit to each work center.

12. The method for continuous manufacture of apparel of claim 1, wherein each tub contains any additional materials needed for component manufacturing operations.

13. The method for continuous manufacture of apparel of claim 1, wherein said carts contain wheels for rolling along said cart traffic patterns or gliding along said traffic patterns via a system of pulleys.

14. The method for continuous manufacture of apparel of claim 1, wherein said carts comprise a plurality of flanges on which lips of said tubs may be engaged for transporting said tubs via said carts.

15. The method for continuous manufacture of apparel of claim 14, wherein said carts further comprise a foldable shelf such that when said shelf is in a downward position it provides a cover for a tub resting on an uppermost set of flanges, and when said shelf is in an upward position it does not effect use of the carts.

16. The method for continuous manufacture of apparel of claim 14 or 15, wherein said carts further comprise a plurality of foldable arms such that when said arms are in an open position an enclosure having right and left sides is created on said carts, and when said arms are in a closed position they do not effect use of the carts.

17. The method for continuous manufacture of apparel of claim 15, wherein materials and finished components can be placed on said carts either folded or hung.

18. The method for continuous manufacture of apparel of claim 1, wherein there are six work centers located around the central staging area, each of said work centers performing material handling tasks that are unique to that work center.

19. The method for continuous manufacture of apparel of claim 18, wherein said central staging area and said work centers are hexagonally shaped.

20. The method for continuous manufacture of apparel of claim 1, wherein said parking spaces in said central staging area are grouped in clusters of four.

21. The method for continuous manufacture of apparel of claim 20, wherein aisles between parking clusters are uni-directional and each cart is constrained to move in a single direction on its first move from its parking space.

22. The method for continuous manufacture of apparel of claim 1, wherein carts travel via uni-directional aisles within each work center, and uni-directional routes along a circumference and a diameter of said central staging area.

23. The method for continuous manufacture of apparel of claim 1, where defects are handled by adding extra instructions to the instruction ticket for the work-in-process batch containing each defect.

24. The method for continuous manufacture of apparel of claim 23, wherein all defects are processed within a unique work center.

* * * * *